US012612562B2

(12) United States Patent
Liu et al.

(10) Patent No.: US 12,612,562 B2
(45) Date of Patent: Apr. 28, 2026

(54) THERMAL CONVERSION OF HEAVY HYDROCARBONS TO MESOPHASE PITCH

(71) Applicant: ExxonMobil Chemical Patents Inc., Baytown, TX (US)

(72) Inventors: Yifei Liu, Houston, TX (US); Teng Xu, Houston, TX (US); Stephen T. Cohn, Spring, TX (US); Jeffrey C. Yeh, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 202 days.

(21) Appl. No.: 18/553,798

(22) PCT Filed: Apr. 6, 2022

(86) PCT No.: PCT/US2022/023706
§ 371 (c)(1),
(2) Date: Oct. 3, 2023

(87) PCT Pub. No.: WO2022/216850
PCT Pub. Date: Oct. 13, 2022

(65) Prior Publication Data

US 2024/0218263 A1 Jul. 4, 2024

Related U.S. Application Data

(60) Provisional application No. 63/172,340, filed on Apr. 8, 2021.

(51) Int. Cl.
*C10G 9/36* (2006.01)

(52) U.S. Cl.
CPC ..... *C10G 9/36* (2013.01); *C10G 2300/4006* (2013.01); *C10G 2300/4012* (2013.01); *C10G 2300/807* (2013.01)

(58) Field of Classification Search
CPC ..... C10G 9/36; C10G 2300/4006; C10G 2300/4012; C10G 2300/807; C10C 3/002; D01F 9/145
See application file for complete search history.

(56) References Cited

U.S. PATENT DOCUMENTS 3,928,170 A * 12/1975 Takahashi ..... C10C 3/002 208/128
4,208,267 A 6/1980 Diefendorf et al. ..... 208/22
(Continued)

FOREIGN PATENT DOCUMENTS

JP S61-26692 2/1986 ..... C01B 31/00
JP S62-34985 A 2/1987
(Continued)

OTHER PUBLICATIONS

Prediction and extension of curves of distillation of vacuum residue using probability functions, Journal of Physics: Conference Series 687, (Year: 2016).*
(Continued)

*Primary Examiner* — Prem C Singh
*Assistant Examiner* — Juan C Valencia
(74) *Attorney, Agent, or Firm* — C. Tumey Law Group PLLC

(57) ABSTRACT

A process for producing mesophase pitch, the process including: providing a feedstock having a T5≥400° F. (204° C.) and a T95≤1,400° F. (760° C.); heating the feedstock at a temperature of at least 450° C. to produce a heat treated product including mesophase pitch, wherein the heating is conducted under reaction conditions sufficient to have an equivalent reaction time greater than or equal to 1,000 seconds; and recovering the mesophase pitch.

16 Claims, 2 Drawing Sheets

(56) References Cited

U.S. PATENT DOCUMENTS

| | | | | | |
|---|---|---|---|---|---|
| 4,240,898 | A | * | 12/1980 | Gomi | C10C 3/002 208/44 |
| 4,312,742 | A | | 1/1982 | Hayashi | |
| 4,402,928 | A | * | 9/1983 | Lewis | D01F 9/145 423/447.2 |
| 4,518,483 | A | | 5/1985 | Dickakian | 208/44 |
| 4,596,652 | A | | 6/1986 | Shibatani et al. | 208/44 |
| 5,032,250 | A | | 7/1991 | Romine et al. | 208/39 |
| 5,259,947 | A | | 11/1993 | Kalback et al. | 208/44 |
| 8,105,479 | B2 | | 1/2012 | Ou et al. | 208/44 |
| 9,222,027 | B1 | | 12/2015 | Malone et al. | C10C 3/002 |
| 2019/0078023 | A1 | | 3/2019 | Mahfouz et al. | C10C 3/002 |
| 2019/0382665 | A1 | | 12/2019 | Sorensen | C10G 1/002 |
| 2020/0181497 | A1 | | 6/2020 | Brown et al. | C10C 3/08 |

FOREIGN PATENT DOCUMENTS

| | | | | |
|---|---|---|---|---|
| JP | H3-167291 | A | 7/1991 | |
| WO | 2017217972 | A1 | 12/2017 | |
| WO | WO2022/155029 | | 7/2022 | C10C 3/00 |

OTHER PUBLICATIONS

Japanese Office Action for JP Patent Application No. 2023-561733 dated Nov. 25, 2024. English Machine Translation with Original Untranslated Version, PDF file. 8 pages.

Edie, D. D. et al. (1989) "Melt Spinning Pitch-Based Carbon Fibers," *Carbon*, v.27(5), pp. 647-655.

* cited by examiner

THERMAL CONVERSION OF HEAVY HYDROCARBONS TO MESOPHASE PITCH

CROSS-REFERENCE TO RELATED APPLICATIONS

This application is a national stage filing of Patent Cooperation Treaty Application No. PCT/US2022/023706 filed Apr. 6, 2022, claiming the benefit of and priority to U.S. Provisional Application No. 63/172,340 filed Apr. 8, 2021, the disclosure of 63/172,340 is incorporated herein by reference.

RELATED APPLICATIONS

The present disclosure is related by technology to U.S. Provisional Patent Application 63/138,051, filed Jan. 15, 2021, the entirety of which is hereby incorporated by reference.

FIELD

The present disclosure relates the production of mesophase pitch, typically for use in production of carbon fiber.

BACKGROUND

Isotropic pitch and mesophase pitch are carbon-containing feedstocks that can be formed from residues generated during processing of coal or petroleum feedstocks or by other methods, such as acid catalyzed condensation of small aromatic species. For some grades of carbon fiber, isotropic pitch can be used as an initial feedstock. However, carbon fibers produced from isotropic pitch generally exhibit little molecular orientation and relatively poor mechanical properties. In contrast to carbon fibers formed from isotropic pitch, carbon fibers produced from mesophase pitch exhibit highly preferred molecular orientation and relatively excellent mechanical properties.

Conventionally, mesophase pitch can be produced via thermal conversion of heavy aromatic hydrocarbons to isotropic pitch at medium to high pressure (>400° C. and >300 psi) in a visbreaker followed by sequential isopitch separation using a wiped film evaporator. Isotropic pitch is converted into mesophase at >420° C. in batch mode typically under vacuum and with a long residence time, e.g., >6 hours. The batch process is difficult to scale-up due to temperature inhomogeneity and high propensity for coke formation in a large autoclave. The current state of art is typically limited to about a 100 gal size. The inefficient batch process leads to high production cost for mesophase.

The purpose for isopitch formation in the mesophase production process is to generate and concentrate carbonaceous species, namely micro carbon residue (MCR), which potentially could be the mesophase precursor. The autoclave process for mesophase production typically runs at temperatures greater than 425° C. with long residence time, low hydrocarbon partial pressure and oftentimes in vacuum. Consequently, the cost to produce mesophase is very high, which inevitably leads to expensive pitch-based carbon fiber.

Despite the exceptionally high performance of pitch-based carbon fiber vs. steel, pitch-based carbon fiber is limited to niche applications such as satellites, sporting goods, rocket engine nozzles etc. largely due to the high cost of mesophase production.

U.S. Pat. No. 4,208,267 describes methods for forming a mesophase pitch. An isotropic pitch sample is solvent extracted. The extract is then exposed to elevated temperatures in the range of 230° C. to about 400° C. to form a mesophase pitch.

U.S. Pat. No. 5,032,250 describes processes for isolating mesophase pitch. An isotropic pitch containing mesogens is combined with a solvent and subjected to dense phase or supercritical conditions and the mesogens are phase separated.

U.S. Pat. No. 5,259,947 describes a method for forming a solvated mesophase comprising: (1) combining a carbonaceous aromatic isotropic pitch with a solvent: (2) applying sufficient agitation and sufficient heat to cause the insoluble materials in said combination to form suspended liquid solvated mesophase droplets: and (3) recovering the insoluble materials as solid or fluid solvated mesophase.

US Patent Publication 2019/0078023 describes upgrading crude oil and oil residues to produce mesophase pitch and additional petrochemicals in an integrated process.

Other potential references of interest include U.S. Pat. Nos. 4,518,483, 9,222,027, US Patent Pub. 2019/0382665, and US Patent Pub. 2020/0181497.

SUMMARY

Figure 1:
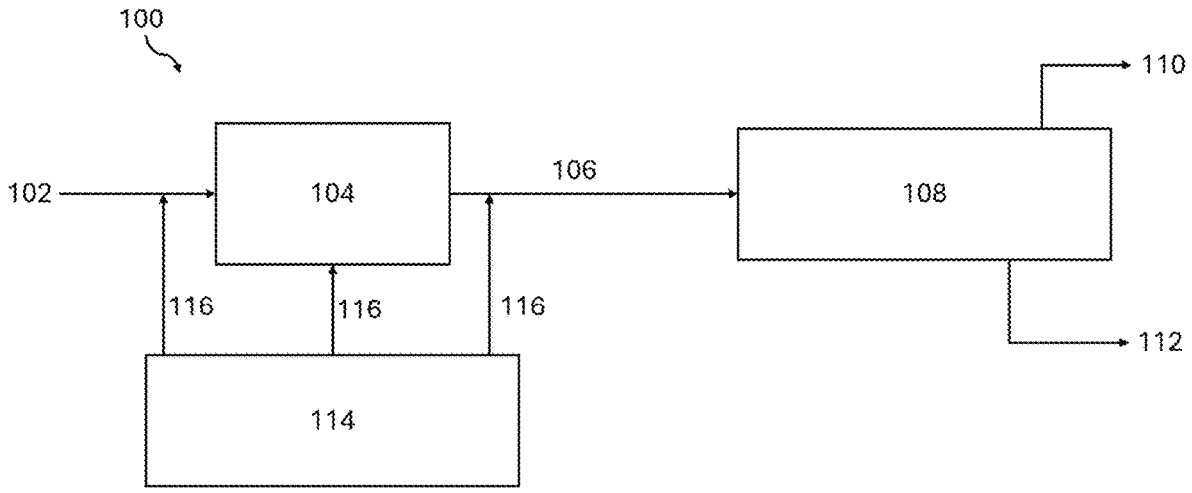
FIG. 1 illustrates an exemplary process and system for mesophase production.

A process for producing mesophase pitch, the process including: providing a feedstock having a T5≥40 0° F. (204° C.) and a T95≤1,400° F. (760° C.); heating the feedstock at a temperature of at least 450° C. to produce a heat treated product including mesophase pitch, wherein the heating is conducted under reaction conditions sufficient to have an equivalent reaction time greater than or equal to 1,000 seconds: and recovering the mesophase pitch.

In the process, the temperature can be below 600° C.

In the process, the feedstock can have a hydrogen content of 5.5 to 10 wt %.

In the process, the heating is an only heating step applied to the feedstock to produce the mesophase pitch.

The process can further include injecting steam into a reactor in which the heating is occurring.

The process can further include injecting steam into the feedstock as the feedstock is supplied to the reactor.

The process can further include injecting steam into a heat treated product including the mesophase pitch output from a reactor in which the heating is occurring.

In the process, the yield of the mesophase pitch can be more than 1 wt %.

In the process, a yield of the mesophase pitch can range from 10 wt % to 50 wt %.

In the process, a yield of the mesophase pitch can range from 10 wt % to 60 wt %.

In the process, the reaction conditions can include an inert atmosphere, a temperature ranging from 450° C. to 520° C., and a pressure ranging from 500 to 1,500 psig.

In the process, X is the equivalent reaction time (ERT) of the heating, and Y is the bromine number of the feedstock as measured in accordance with ASTM D1159, and the heating is conducted under reaction conditions sufficient to satisfy the relationship [X*Y]≥31,000 seconds.

The process can further include controlling a temperature of the heating step to cause the equivalent reaction time to be greater than 1,000 seconds.

The process can include the feedstock including a fraction having a boiling point of ≥1,050° F. (566° C.) ranging from about 1 wt % to about 40 wt % based on the weight of the feedstock.

In the process, the feedstock can include at least one member selected from the group consisting of main column bottoms (MCB), hydroprocessed MCB, steam cracker tar, hydrotreated steam cracker tar, heavy coker gas oil, steam cracker gas oil, vacuum resid, deasphalted residue or rock, and mixtures or combinations thereof.

In the process, the recovering the mesophase pitch can include separating the mesophase pitch from light hydrocarbons.

In the process, the heating can performed in a reactor, and the process further comprises controlling a liquid linear velocity in the reactor, which causes mesophase precursors to be in slurry form.

In the process, the controlling can include injecting steam.

A system, including: a reactor configured to receive a feedstock having a T5≥400° F. (204° C.) and a T95≤1,400° F. (760° C.) and to heat the feedstock at a temperature of at least 450° C. to produce a heat treated product including mesophase pitch, wherein the reactor is configured to heat the feedstock under reaction conditions sufficient to have an equivalent reaction time greater than or equal to 1,000 seconds: and a separation device in fluid communication with the reactor, wherein the separator is configured to separate mesophase pitch from an effluent received from the reactor.

The system can further include a steam injector configured to inject steam into the reactor, into the effluent, and/or into the feedstock.

In the system, the separator can a cyclone separation device.

In the system, the separator can be a deasphalter.

DETAILED DESCRIPTION

Unexpectedly, it has been discovered that mesophase pitch can be produced from a slurry oil in a single thermal step. This unexpected result opens up the possibility for a continuous, one-step thermal process to mesophase pitch as illustrated in FIG. 1. An embodiment of the present technological advancement can utilize a single thermal step using a continuous flow tubular reactor at an operating pressure greater than 400 psig (measured at the reactor inlet). When compared to conventional process, the tubular reactor operates at a higher temperature, but with a shorter residence time to mitigate coking, while matching run severity. For example, a continuous tubular reactor running at 500° C. with 15 minute residence time is equivalent to 4,000 equivalent sec severity. Steam cofeeding into the tubular reactor, before the input of the reactor, or after the output of the reactor can be employed. A separation device, e.g., a cyclone via gravitational separation or a DAU (deasphalting unit) via solubility, can separate mesophase from light hydrocarbons and steam.

Mesophase can be made through one step thermal process, which is different from the two-step process mentioned in the background section. Feedstock with relatively higher H content (i.e., 5.5 wt % to 10 wt %, preferably 7-8 wt %) than isopitch (i.e., 5-6 wt %), such as main column bottoms (MCB), can be directly converted to mesophase at elevated temperatures. An exemplary embodiment of the present technological advancement can include: (1) heat treating feedstock at a severity condition that is higher than the typical visbreakering condition; (2) pressure is set constant (or substantially constant with variations not exceeding +/−10% over the residence time) during the reaction which induces stripping of light distillates from reactor vessel: (3) long residence time allows for sufficient aromatic polymerization to form ordered mesophase which is in anisotropic form and can be measured by polarized light microscope due to its inherent birefringence: and (4) recover mesophase by separating the mesophase from light hydrocarbons, e.g., cyclone or simply decanting liquid products in case of a batch process.

Various embodiments described herein provide processes for the production of mesophase pitch from a heavy feedstock having a T5≥400° F. (204° C.) and a T95≤1,400° F. (760° C.). However, other feedstocks from MCB can be used with the present technological advancement.

Generally, the single heat treatment of the heavy feedstock is conducted at a temperature ranging from about 450° C. to about 520° C. and a residence time of 5 minutes to 8 hours, more preferably from about 3 hours minutes to about six hours, more preferably from 5 minutes to 1 hour, such as about 10 minutes to about 60 minutes (or one hour), and most preferably from 5 minutes to 30 minutes.

All numerical values within the detailed description and the claims herein are modified by "about" or "approximately" the indicated value, and take into account experimental error and variations that would be expected by a person having ordinary skill in the art. Unless otherwise indicated, room temperature is about 23° C.

As used herein, "wt %" means percentage by weight, "vol %" means percentage by volume, "mol %" means percentage by mole, "ppm" means parts per million, and "ppm wt" and "wppm" are used interchangeably to mean parts per million on a weight basis. All "ppm" as used herein are ppm by weight unless specified otherwise. All concentrations herein are expressed on the basis of the total amount of the composition in question. All ranges expressed herein should include both end points as two specific embodiments unless specified or indicated to the contrary.

Definitions

For the purpose of this specification and appended claims, the following terms are defined.

As used herein, the term "equivalent reaction time" or "equivalent residence time" (ERT) refers to the severity of an operation, expressed as seconds of residence time for a reaction having an activation energy of 54 kcal/mol in a reactor operating at 468° C. The ERT of an operation is calculated as follows:

$$ERT = W \times \frac{e^{\left(-\frac{E_a}{R \times (T_{rxn})}\right)}}{e^{\left(-\frac{E_a}{R \times (741K)}\right)}}$$

where W is the residence time of the operation in seconds: e is 2.71828; $E_a$ is 225.936 J/mol: R is 8.3145 $J \cdot mol^{-1} \cdot K^{-1}$; and $T_{rxn}$ is the temperature of the operation expressed in Kelvin. In very general terms, the reaction rate doubles for every 12 to 13° C. increase in temperature. Thus, 60 seconds of residence time at 468° C. is equivalent to 60 ERT, and increasing the temperature to 501° C. would make the operation five times as severe, i.e. 300 ERT. Expressed in another way, 300 seconds at 468° C. is equivalent to 60 seconds at 501° C., and the same product mix and distribution should be obtained under either set of conditions.

As used herein, the term "pitch" refers to a viscoelastic carbonaceous residue obtained from distillation of petroleum, coal tar, or organic substrates. Unless otherwise specified herein, the term "pitch" refers to petroleum pitch (i.e., pitch obtained from distillation of petroleum).

As used herein, the term "isotropic pitch" refers to pitch comprising molecules which are not aligned in optically ordered liquid crystals.

As used herein, the term "main column bottoms (MCB)" refers to a bottoms fraction from a fluid catalytic cracking process. More particularly, MCB refers to the fraction of the product of the catalytic cracking process which boils in the range of the catalytic cracking process which boils in the range of from about 200° C. to 650° C. However, the boiling point range could vary depending on the operating conditions.

As used herein, the term "mesophase pitch" or "mesophase" refers to pitch that is a structurally ordered optically anisotropic liquid crystal. Mesophase structure can be described and characterized by various techniques such as optical birefringence, light scattering, or other scattering techniques.

Test Methods

Mesophase Pitch Content Via Optical Microscopy

Unless otherwise specified herein, the mesophase pitch content of a sample is determined via optical microscopy in accordance with the following procedure. A digital image of the sample is generated using optical microscopy. A histogram of the total pixel count of the digital image is then prepared by color intensity, with lighter intensity regions corresponding to mesophase pitch due to its high refractivity. The image is divided into mesophase pitch and non-mesophase pitch areas via thresholding, with the area having an intensity less than a certain threshold corresponding to mesophase pitch. An estimate of the mesophase pitch content of the sample in % area (which result can then be extrapolated as corresponding to an estimate of % vol) is then obtained by subtracting out the non-mesophase pitch area of the image followed by dividing the total amount of the mesophase pitch area of the image by the total area of the image.

Certain aspects of the invention will now be described in more detail. Although the following description relates to particular aspects, those skilled in the art will appreciate that these are exemplary only, and that the invention can be practiced in other ways. References to the "invention" may refer to one or more, but not necessarily all, of the inventions defined by the claims. The use of headings is solely for convenience, and these should not be interpreted as limiting the scope of the invention to particular aspects.

Heavy Feedstock

In the processes of the present disclosure, the heavy feedstock may be characterized by boiling range. One option for defining a boiling range is to use an initial boiling point for a feed and/or a final boiling point for a feed. Another option, which in some instances may provide a more representative description of a feed, is to characterize a feed based on the amount of the feed that boils at one or more temperatures. For example, a "T5" boiling point for a feed is defined as the temperature at which 5 wt % of the feed will boil off. Similarly, a "T95" boiling point is a temperature at 95 wt % of the feed will boil. The percentage of a feed that will boil at a given temperature can be determined, for example, by the method specified in ASTM D2887 (or by the method in ASTM D7169, if ASTM D2887 is unsuitable for a particular fraction). Generally, the heavy feedstock may have a T5≥400° F. (204° C.) and a T95 of ≤1,400° F. (760° C.). Examples of such heavy feedstocks include those having a 1,050° F.+(566° C.+) fraction. In some aspects, the 566° C.+ fraction can correspond to 1 wt % or more of the heavy feedstock (i.e., a T99 of 566° C. or higher), or 2 wt % or more (a T98 of 566° C. or higher), or 10 wt % or more (a T90 of 566° C. or higher), or 15 wt % or more (a T85 of 566° C. or higher), or 30 wt % or more (a T70 of 566° C. or higher), or 40 wt % or more (a T60 of 566° C. or higher), such as from about 1 wt % to about 40 wt % or about 2 wt % to about 30 wt %.

The heavy feedstock of the present disclosure may be characterized by reactivity as measured by its bromine number. The heavy feedstocks of the present disclosure may have a bromine number as measured in accordance with ASTM D1159 of ≥3, or ≥5, or ≥10, or ≥30, or ≥40, such as from about 3 to about 50, or from about 5 to about 40, or from about 10 to about 30.

The heavy feedstock of the present disclosure may be characterized by an aromatic content. The heavy feedstocks of the present disclosure can include about 40 mol % or more of aromatic carbons, or about 50 mol % or more, or about 60 mol % or more, such as up to about 75 mol % or possibly still higher. The aromatic carbon content of the heavy feedstock can be determined according to ASTM D5186.

The heavy feedstock of the present disclosure may be characterized by an average carbon number. The heavy feedstocks of the present disclosure may be composed of hydrocarbons having an average carbon number of about 33 to about 45 (e.g., about 35 to about 40, or about 37 to about 42, or about 40 to about 45).

The heavy feedstock of the present disclosure may be characterized by a micro carbon residue (MCR) as determined by ASTM D4530-15. The heavy feedstocks of the present disclosure may have an MCR of about 5 wt % or greater (e.g., about 5 wt % to about 45 wt %, or about 10 wt % to about 45 wt %).

The heavy feedstock of the present disclosure may be characterized by a hydrogen content. The heavy feedstocks of the present disclosure generally have a hydrogen content of about 6 wt % to about 11 wt %, such as from about 6 wt % to about 10 wt %, or from about 7 wt % to about 8 wt %.

The heavy feedstock of the present disclosure may be characterized by a cumulative concentration of polynuclear aromatic hydrocarbons (PNAs) and polycyclic aromatic hydrocarbons (PAHs). The feedstocks of the present disclosure may have a cumulative concentration of partially hydrogenated PNAs and partially hydrogenated PAHs of about 20 wt % or greater (e.g., about 50 wt % to about 90 wt %).

In some aspects, suitable heavy feedstocks can include about 50 wppm to about 10,000 wppm elemental nitrogen or more (i.e., weight of nitrogen in various nitrogen-containing compounds within the feedstock). Additionally or alternately, the heavy feedstock can include about 100 wppm to about 20,000 wppm elemental sulfur, preferably about 100 wppm to about 5,000 wppm elemental sulfur. Sulfur will usually be present as organically bound sulfur. Examples of such sulfur compounds include the class of heterocyclic sulfur compounds such as thiophenes, tetrahydrothiophenes, benzothiophenes and their higher homologs and analogs.

Other organically bound sulfur compounds include aliphatic, naphthenic, and aromatic mercaptans, sulfides, and di- and polysulfides.

Examples of suitable heavy feedstocks include, but are not limited to, main column bottoms (MCB), steam cracker tar, heavy coker gas oil, steam cracker gas oil, vacuum resid, deasphalted residue or rock, hydroprocessed or hydrotreated forms of any of the foregoing, and combinations of any of the foregoing. A preferred heavy feedstock may be a hydroprocessed MCB. Another preferred example of heavy feedstock is a hydrotreated steam cracker tar. Steam cracker tar and subsequent hydrotreating can be produced/performed by any suitable method including for example, as disclosed in U.S. Pat. No. 8,105,479, which is incorporated herein by reference in its entirety.

Heat Treatment

In the processes of the present disclosure, the heavy feedstock is generally subjected to a heat treatment step to dealkylate and/or dehydrogenate the heavy feedstock and produce an isotropic pitch and mesophase pitch. Advantageously, and unexpectedly, it has been discovered that the yield of the mesophase pitch can be increased by using higher temperatures in a single heating step. More particularly, generally, the heat treatment may be conducted at a temperature ranging from about 450° C. to about 550° C., preferably from about 480° C. to about 510° C. and a residence time ranging from about 5 minutes to 8 hours, more preferred from about 5 minutes to about an hour, and most preferred from about 5 minutes to about 30 minutes, such as about 10 minutes to about 30 minutes. Typically, the requisite severity of the heat treatment conditions increases as the bromine number of the heavy feedstock decreases. Generally, the heat treatment is conducted under conditions sufficient to satisfy the relationship $[X*Y] \geq 31{,}000$ seconds (e.g., ≥40,000 seconds, or ≥50,000 seconds, or ≥60,000 seconds or ≥100,000 seconds, or ≥200,000 seconds, or ≥500,000 seconds) wherein X is the equivalent reaction time of the heating, and wherein Y is the bromine number of the feedstock. For example, [X*Y] may range from about 31,000 to about 1,000,000 seconds, such as from about 40,000 seconds to about 700,000 second, or from about 50,000 seconds to about 500,000 seconds, or from about 50,000 seconds to about 100,000 seconds. For example, in embodiments where the heavy feedstock has a bromine number ≥10, the minimum ERT of the heat treatment step may be about 2,000 seconds or less, such as a minimum ERT of 500 seconds. In embodiments where the heavy feedstock has a bromine number ≤10, the minimum ERT of the heat treatment step may be greater than about 2,000 seconds, such as a minimum ERT of 10,000 seconds, or alternatively, a minimum ERT of 8,000 seconds.

Suitable pressures of the heat treatment step may range from about 200 psig (1,380 kPa-g) to about 2,000 psig (13,800 kPa-g), such as from about 400 psig (2,760 kPa-g) to about 1,800 psig (12.400 kPa-g), and most preferably about 1,000 psig (6,894 kPa-g), measured at the reactor inlet. The heat treatment may be conducted in any suitable vessel, such as a tank, piping, tubular reactor, or distillation column. An example of a suitable reactor configuration that may be employed to conduct the heat treating is described U.S. Pat. No. 9,222,027, which is incorporated herein by reference in its entirety.

Mesophase Pitch

The resultant mesophase pitch obtained from the heat treatment (and optional subsequent separation step(s)) may be characterized by a micro carbon residue (MCR) as measured in accordance with ASTM D4530-15. Generally, the mesophase pitch of the present disclosure may have an MCR of 30 wt % or greater (e.g., preferably about 50 wt % or greater, even more preferably about 60 wt % or greater).

Any characterizations of a softening point were measured in accordance with ASTM D3104-14.

Mesophase pitch content was measured in accordance with ASTM D4616-95(2018).

Carbon Fiber

The mesophase pitch obtained from the processes described herein can be used to form carbon fibers, such as by using a conventional melt spinning process. Melt spinning for formation of carbon fiber is a known technique. For example, the book "Carbon-Carbon Materials and Composites" includes a chapter by D. D. Edie and R. J. Diefendorf titled "Carbon Fiber Manufacturing." Another example is the article "Melt Spinning Pitch-Based Carbon Fibers", Carbon, v. 27(5), p 647, (1989).

Process Overview

The processes disclosed herein may be a continuous or semi-continuous processes, but is preferably a continuous process. FIG. 1 shows an overview of a non-limiting example process 100 of the instant disclosure. A heavy feedstock 102 is subjected to a heat treatment step in vessel (preferably a tubular reactor) 104 under conditions sufficient to satisfy the relationship $[X*Y] \geq 31{,}000$ seconds, wherein X is the equivalent reaction time of the heating, and wherein Y is the bromine number of the feedstock 102 (alternative, the severity is such that the heating creates an ordered liquid crystalline mesophase). The heat treatment step carried out in vessel 104 results in formation of a heat treated product or effluent 106 comprising mesophase pitch. Optionally, the heat treated product 106 can undergo a separation step in separator 108 to form light hydrocarbons and steam fraction 110 and mesophase pitch 112. The optional steam injector 114 can inject steam 116 into the feedstock 102 before the vessel 104, into vessel 104, or into effluent 106 after the vessel 104.

The following provides exemplary details regarding how the method of FIG. 4 could be executed. A heavy hydrocarbon feed, e.g., MCB, can be fed into a tubular reactor that runs at 500 to 1,500 psig pressure and high enough severity, e.g., >1,000 equivalent seconds, preferably >2,000 equivalent seconds, to make the mesophase precursors. The temperature in the tubular reactor can range from 450° C. to 600° C., or more preferably from 450° C. to 520° C. The formed mesophase precursors can be kept in a slurry form in the tubular reactor to prevent reactor plugging. This can be done by increasing the liquid linear velocity in the tubular reactor to, for example, >1 ft/sec, or preferably, >4 feet/sec. Optionally one can inject steam around the reactor tube or at the exit of the reactor tube to increase linear velocity. The effluent can be sent into a separator, e.g., cyclone, which operates at ambient pressure to 50 psig, to separate the light hydrocarbons (and steam) from mesophase. The mesophase yield can range from 10 to 60%, preferably 13-50%, depending on the severity (higher severity, higher mesophase yield). The light hydrocarbons and steam can be further separated via conventional distillation to recover the light hydrocarbon. The light hydrocarbon can be optionally recycled to the inlet of the tubular reactor.

U.S. Pat. No. 4,518,483 claimed to first extract the asphaltene fraction (heptane insoluble) of the heavy hydrocarbon feedstock (MCB, etc.), and subsequently convert the asphaltene to mesophase in the batch mode heat soaking unit. It was subsequently followed by vacuum distillation or steam stripping to concentrate mesophase by removing lights. Asphaltene would be very hard to transfer and process as a feed considering it's relatively higher softening point compared to MCB. In contrast, the continuous process of the present technological advancement is designed to convert the heavy feedstock as a whole. Additionally, mesophase is produced without the aid of stripping to concentrate mesophase. The severity condition is different from U.S. Pat. No. 4,518,483 and mesophase can be separated by gravitational force using a cyclone instead.

The following examples illustrate the present invention. Numerous modifications and variations are possible and it is to be understood that within the scope of the appended claims, the invention may be practiced otherwise than as specifically described herein.

EXAMPLES

Example 1: High Severity Thermal Conversion of Heavy Hydrocarbon Feedstock

Figure 2:
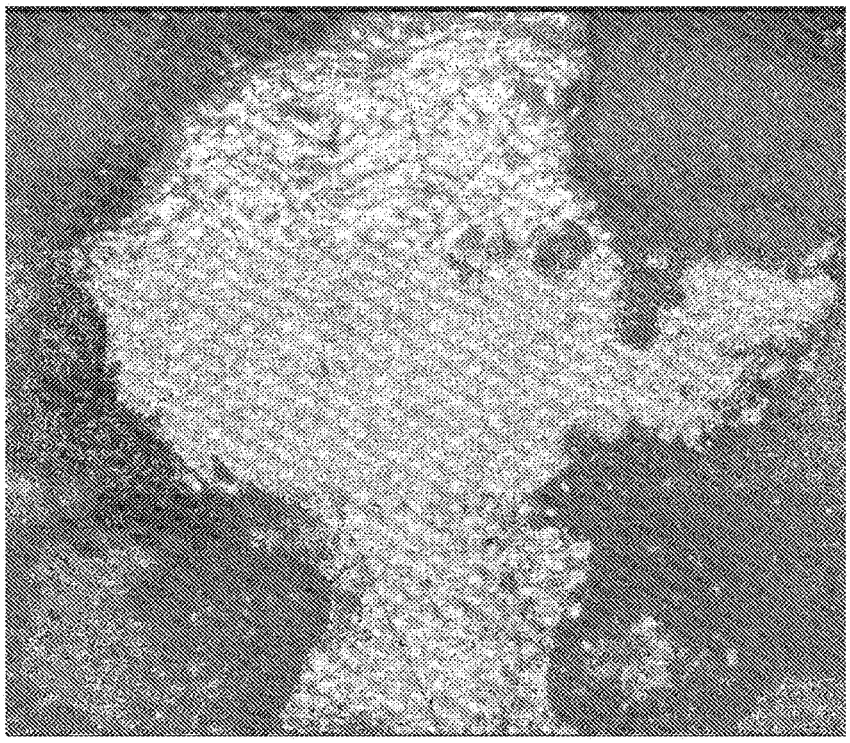
FIG. 2 is an image of solid product generated by an embodiment of the present technological advancement.
Figure 3:
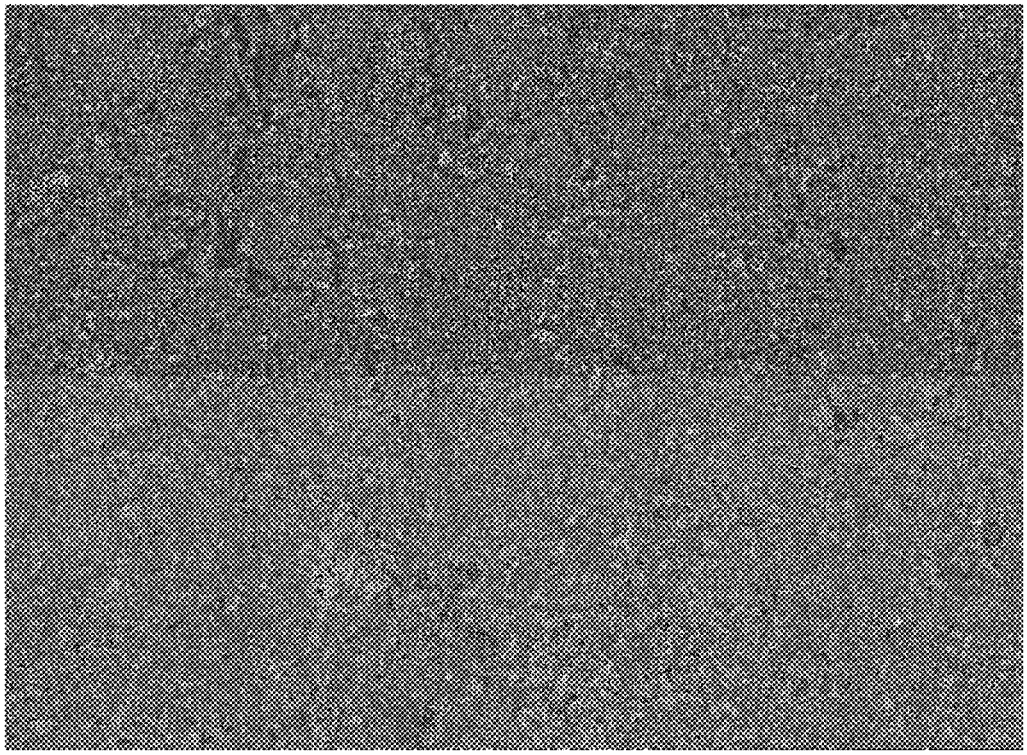
FIG. 3 is an image of solid product generated by an embodiment of the present technological advancement.

Main column bottoms (MCB) from a refinery site were used to generate mesophase through a single thermal reaction (i.e., only one heating step is applied to the MCB feedstock to produce the mesophase). The MCB feedstock used in the example has about 6% in the 566° C.+ fraction (a T94.5 of 567° C.). Table 1 shows the severity condition of three mesophase pitch preparation processes and their corresponding equivalent reaction time (ERT). Equivalent reaction time (ERT) is used to quantify the degree of severity with higher number being more severe. ERT refers to the relative residence time at a designated process condition with respect to a typical visbreaking condition at 468° C. with an activation energy of 54 kcal/mol. Visbreaker is typically operated from 300 to 1.000 ERT. The mesophase production process was conducted in an autoclave where the feedstock was heat treated under an inert environment at high pressure. The MCB undergoes thermal dealkylation and dehydrogenation to remove lights while polymerizing to make condensed aromatic ring structures. The product can be separated into two phases at elevated temperatures, with one portion of the product being a total liquid product (TLP) and the other portion remaining as a solid. TLP typically has a softening point less than 100° C. and the solid has a softening point greater than 250° C. As the severity of MCB conversion increases, the yield of the solid increases while the yield of TLP decreases as shown in Table 1. At 460° C., the solid product exhibits the mesophase feature as shown in FIG. 2 with a mesophase content greater than 80%. The H content is 4.81 wt % and it falls into the typical H range for mesophase which is between 4.5 to 5 wt %. Similarly, solid recovered at 470° C. and 480° C. also exhibits optical features of mesophase under microscope and the yield of solid is able to reach 46% at 480° C. with a mesophase content of 75-85%.

The data in Table 1 shows that mesophase yield can range from 10 to 50 wt %, or preferably 13 to 46 wt %, be greater than 1 wt %, greater that 13 wt %, or be greater than 22 wt %. While the data in Table 1 was generated from an autoclave in batch mode, kinetics evidences that the present technological advancement will produce a similar amount of mesophase under identical residence time in a continuous process.

TABLE 1

Process condition and ERT of the selected isotropic pitch production

| Run Number | 1 | 2 | 3 | 4 |
|---|---|---|---|---|
| ERT | 2378 | 3907 | 6334 | 850 |
| Temperature (° C.) | 460 | 470 | 480 | 440 |
| Pressure (psi) | 1000 | 1000 | 1000 | 1000 |
| Residence time (h) | 1 | 1 | 1 | 1 |
| TLP yield (wt %) | 64.4 | 46.8 | 22.8 | 80 |
| TLP MCR (%) | 40.2 | 44.8 | 58.2 | 24.1 |
| Mesophase yield (wt %) | 13.2 | 22.4 | 46 | Negligible |
| Mesophase MCR (%) | 60 | 72.1 | 74.5 | 0 |
| Material balance excluding gas (%) | 78.0 | 69.6 | 69.2 | 81.5 |

Example 2: Low Severity Thermal Conversion of Heavy Hydrocarbon Feedstock

The feedstock used for this example is the same as the one in Example 1. The MCB was heat treated at 440° C. under 1,000 psi of $N_2$ for 1 hour. The corresponding ERT was around 850 which represents a typical visbreaking condition. No mesophase like material was recovered due to the low severity and TLP yield reaches 81.5% with the remaining as gas and light distillate as shown in Table 1, run number 4. A comparison between Example 1 and 2 suggests that temperature is an important result effective variable to the enhancement of mesophase yield via a one-step thermal conversion embodying the present technological advancement.

Example 3: Cost Effective, Continuous One Step Thermal Process to Mesophase Production Current commercial practice produces mesophase from isopitch in the batch mode with long residence time, moderate to high temperature and likely under vacuum. The batch process can lead to significant fouling issues caused by excessive coking. The handling of mesophase in this process is labor intensive as the mesophase needs to be sampled at elevated temperature before it solidifies in the reactor vessel. Collectively, the commercial batch process leads to high cost of production to mesophase. In contrast, the one-step thermal process of the present technological advancements, which can use a continuous flow tubular reactor and a separator, produces mesophase directly from MCB instead of isopitch, which is an intermediate product of MCB. The tubular reactor can operate at >400 psig, higher temperature but shorter residence time to mitigate coking while matching run severity as that shown in Table 1. For example, a continuous tubular reactor running at 500° C. with 15 minutes residence time is equivalent to 4,000 equivalent sec severity, which is similar to run 2 in Table 1. Steam cofeeding to the tubular reactor could further mitigate coke formation. Cyclone can separate mesophase from light hydrocarbons and steam via gravitational separation. This continuous configuration enables a cost effective option to produce mesophase and reduces cost substantially.

All documents described herein are incorporated by reference herein, including any priority documents and/or testing procedures to the extent they are not inconsistent with this text. As is apparent from the foregoing general description and the specific embodiments, while forms of the present disclosure have been illustrated and described, various modifications can be made without departing from the spirit and scope of the present disclosure. Accordingly, it is not intended that the present disclosure be limited thereby. Likewise, the term "comprising" is considered synonymous with the term "including" for purposes of United States law. Likewise whenever a composition, an element or a group of elements is preceded with the transitional phrase "comprising", it is understood that it is also contemplated that the same composition or group of elements with transitional phrases "consisting essentially of," "consisting of", "selected from the group of consisting of," or "is" preceding the recitation of the composition, element, or elements and vice versa.

What is claimed is:

1. A process for producing mesophase pitch, the process comprising:

providing a feedstock having a T5≥400° F. (204° C.) and a T95≤1,400° F. (760° C.);

heating the feedstock at a temperature of at least 450° C. to produce a heat treated product including mesophase pitch, wherein the heating is conducted under reaction conditions sufficient to have an equivalent reaction time greater than or equal to 1,000 seconds; and recovering the mesophase pitch.

2. The process of claim 1, wherein the temperature is below 600° C.

3. The process of claim 1, wherein the feedstock has a hydrogen content of 5.5 to 10 wt %.

4. The process of claim 1, wherein the heating is an only heating step applied to the feedstock to produce the mesophase pitch.

5. The process of claim 1, further comprising injecting steam, wherein the steam is injected into the reactor, into the feedstock as the feedstock is supplied to the reactor or into a heat treated product including the mesophase pitch output from a reactor in which the heating is occurring.

6. The process of claim 1, wherein a yield of the mesophase pitch is more than 1 wt.

7. The process of claim 1, wherein the reaction conditions include an inert atmosphere, a temperature ranging from 450° C. to 520° C., and a pressure ranging from 500 to 1,500 psig.

8. The process of claim 1, wherein X is the equivalent reaction time (ERT) of the heating, and wherein Y is the bromine number of the feedstock as measured in accordance with ASTM D1159, and the heating is conducted under reaction conditions sufficient to satisfy the relationship [X*Y]≥31,000 seconds.

9. The process of claim 1, further comprising controlling a temperature of the heating step to cause the equivalent reaction time to be greater than 1,000 seconds.

10. The process of claim 1, wherein the feedstock comprises a fraction having a boiling point of ≥1,050° F. (566° C.) ranging from about 1 wt % to about 40 wt % based on the weight of the feedstock.

11. The process of claim 1, wherein the feedstock comprises at least one member selected from the group consisting of main column bottoms (MCB), hydroprocessed MCB, steam cracker tar, hydrotreated steam cracker tar, heavy coker gas oil, steam cracker gas oil, vacuum resid, deasphalted residue or rock, and mixtures or combinations thereof.

12. The process of claim 1, wherein the recovering the mesophase pitch includes separating the mesophase pitch from light hydrocarbons.

13. The process of claim 1, wherein the heating is performed in a reactor, and the process further comprises controlling a liquid linear velocity in the reactor, which causes mesophase precursors to be in slurry form.

14. The method of claim 1, wherein heating the feedstock comprises heating the feedstock in a tubular reactor and wherein a liquid linear velocity of the feedstock in the tubular reactor is >4 ft/sec, wherein reaction conditions in the tubular reactor include an inert atmosphere, a temperature ranging from 450° C. to 520° C., and a pressure ranging from 500 to 1,500 psig.

15. A system, comprising:

a reactor configured to receive a feedstock having a T5≥400° F. (204° C.) and a T95≤1,400° F. (760° C.) and to heat the feedstock at a temperature of at least 450° C. to produce a heat treated product including mesophase pitch, wherein the reactor is configured to heat the feedstock under reaction conditions sufficient to have an equivalent reaction time greater than or equal to 1,000 seconds, and wherein the reactor comprises a means for controlling a liquid linear velocity in the reactor which causes mesophase precursors to be in slurry form; and a separation device in fluid communication with the reactor, wherein the separator is configured to separate mesophase pitch from an effluent received from the reactor.

16. The system of claim 15, further comprising a steam injector configured to inject steam into the reactor, into the effluent, and/or into the feedstock.

* * * * *